United States Patent [19]

Nichols

[11] Patent Number: 4,779,870

[45] Date of Patent: Oct. 25, 1988

[54] FORTUNE TELLING GAME

[76] Inventor: Daphne W. Nichols, 9 Windsor St., Arlington, Mass. 01970

[21] Appl. No.: 22,951

[22] Filed: Mar. 6, 1987

[51] Int. Cl.[4] ..... A63F 9/18

[52] U.S. Cl. ..... 273/161

[58] Field of Search ..... 273/236, 243, 250, 253, 273/161; 434/106

[56] References Cited

U.S. PATENT DOCUMENTS

| | | | |
|---|---|---|---|
| 1,139,356 | 5/1915 | Fields | 273/243 X |
| 2,549,495 | 4/1951 | Lightfoot et al. | 273/161 UX |
| 3,355,822 | 12/1967 | Losey | 273/161 X |
| 3,652,092 | 3/1972 | Boyer et al. | 273/243 |
| 3,796,432 | 3/1974 | Beakley | 273/243 |
| 4,579,345 | 4/1986 | Covey | 273/243 |

FOREIGN PATENT DOCUMENTS

| | | | |
|---|---|---|---|
| 2019228 | 10/1979 | United Kingdom | 273/253 |

*Primary Examiner*—Anton O. Oechsle

[57] ABSTRACT

The fortune telling game of the present invention comprises a game board having top and bottom surfaces, the top surface being divided into twelve equal radial sectors. Each sector has an area embodying one of the twelve celestial or zodiac house signs, an area having displayed house identifying indicia, and an information area having displayed therein indicia giving the characteristics of the zodiac house identified with the related zodiac house area. In combination with a game board is a deck or plurality of playing cards, each of the cards having a bottom surface and a top surface and a top indicia bearing surface. The indicia of each top surface comprises characteristics suggestive of a relationship to at least a portion of the indicia giving the characteristics of a zodiac house when oriented with a particular house sector. The plurality of cards comprises four groups of cards each group of cards bearing indicia of one standard card suit selected from the group consisting of hearts, clubs, spades and diamonds. Other non-suit cards are provided having lunar or solar symbols and having respectively characteristics which suggest mental feelings or attitudes. Also disclosed are methods of playing the fortune telling game.

11 Claims, 4 Drawing Sheets

FORTUNE TELLING GAME

FIELD OF THE INVENTION

The present invention relates to an astrological fortune telling game, and more particularly, to a fortune telling game in which the intuitive and interpretive input of the reader or the player can be used to attain personal answers to simple and complex questions and to foretell events pertaining to the players, another party, or to the relationship between two or more people. The invention includes a deck of cards in combination with a game board and also methods of playing the same.

BACKGROUND OF THE INVENTION

Heretofore, the western or solar astrological fortune-telling has been practiced by preparing a birth zodiac in accordance with a first factor of positions of the sun and the nine planets around the earth in relation to the date and time of one's birth and with a second factor of a geographic place of one's birth. In the preparation of the accurate birth zodiac, the first factor in relation to the date and time of one's birth has been determined with use of a celestial almanac to prepare the first zodiac and then the second factor of the geographic place on one's birth has been taken into consideration in order to calculate the actual planetary positions based on the birth place and to correct the first zodiac into the actual birth zodiac.

The state of the art is exemplified by the following U.S. Patents:

| | |
|---|---|
| 1,370,249 | 3,355,822 |
| 2,549,495 | 4,193,213 |
| 2,846,227 | 4,583,737 |

Accordingly, it is therefore an object of the invention to provide a fortune telling game for amusement which employs in combination a deck of fortune telling cards and game board wherein the orientation of cards with respect to the game board provokes intuitive interpretations of a suggested relationship, of one or more characteristics of the card to one or more of suggested characteristics of the game board to foretell the player's fortune.

SUMMARY OF THE INVENTION

The fortune telling game of the present invention comprises a game board having top and bottom surfaces, the top surface being divided into twelve equal radial sectors. Each sector has an area embodying one of the twelve celestial or zodiac house signs, an area having displayed house identifying indicia, and an information area having displayed therein indicia giving the characteristics of the zodiac house identified with the related zodiac house area. In combination with a game board is a deck or plurality of playing cards, each of the cards having top and bottom surfaces at least one of which is an indicia bearing surface. The indicia on the surface comprises characteristics suggestive of a relationship to at least a portion of the indicia giving the characteristics of a zodiac house when oriented with a particular house sector. The plurality of cards comprises four groups of cards, each group of cards bearing indicia of one standard card suit selected from the group consisting of hearts, clubs, spades and diamonds. Additionally, non-suit cards are provided having lunar or solar symbols and having respectively, characteristics which suggest mental feelings or attitudes.

DETAILED DESCRIPTION OF PREFERRED EMBODIMENTS

Figure 1:
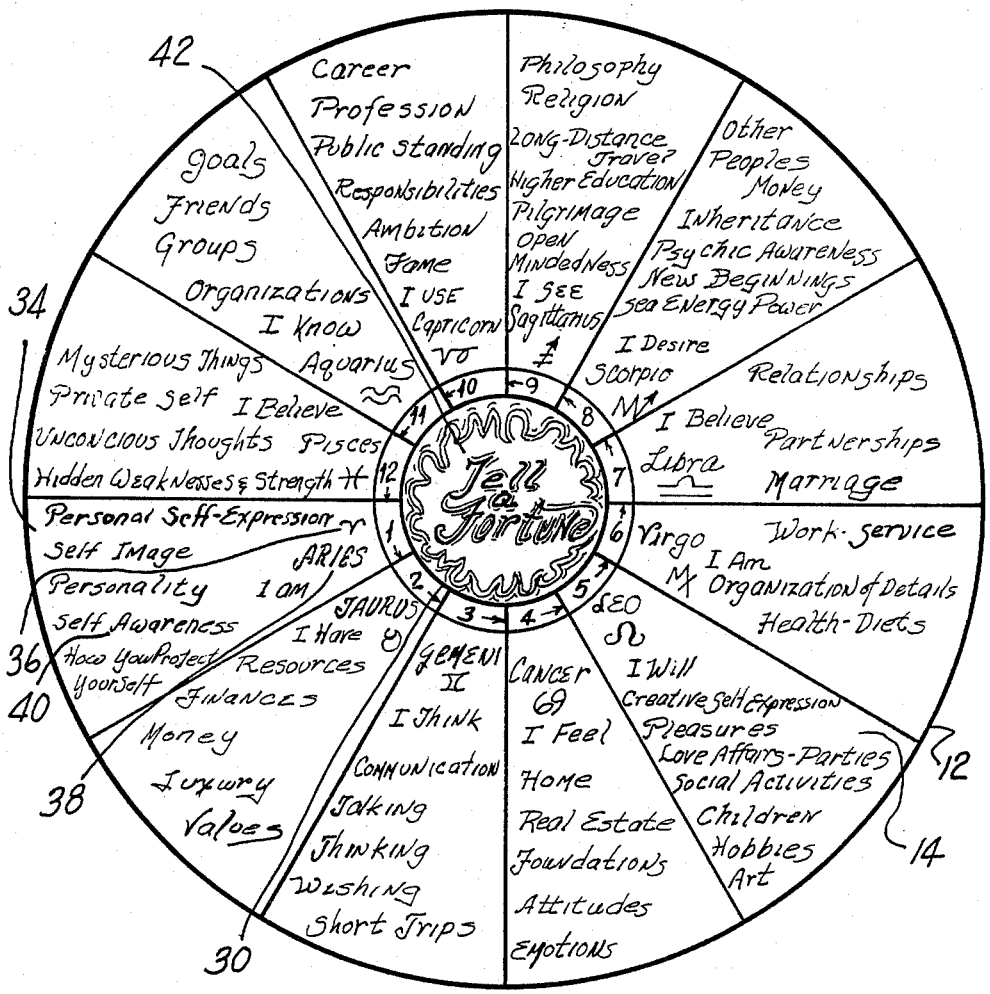
FIG. 1 is a detailed plan view of the game board in accordance with the invention.
Figure 8:
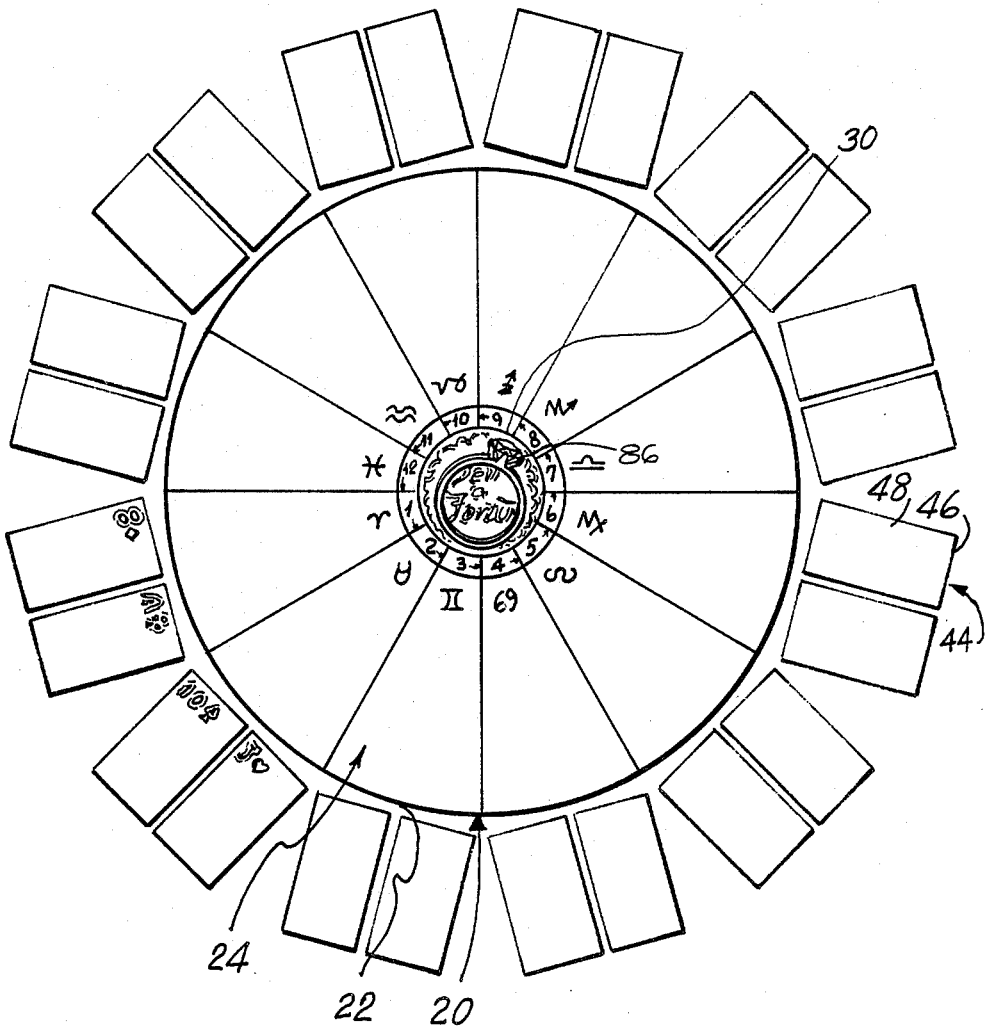
FIG. 8 is a plan view illustrating the game board in combination with playing cards as used in a typical fortune-telling game play.
Figure 9:
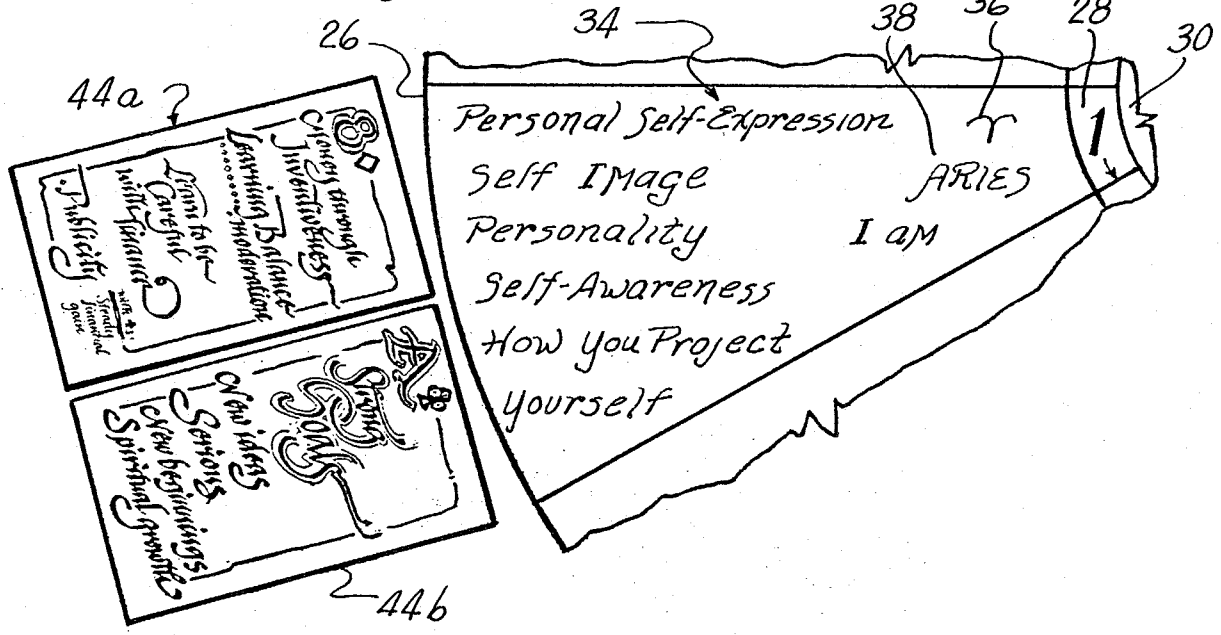
FIG. 9 is an enlarged fragmentary view of a portion of FIG. 8 but including more detail.

Referring now to the drawings and more particularly to FIGS. 1 and 9, there is illustrated generally at 20 (FIG. 8) a game board in accordance with the present invention. The game board 20 has a bottom supporting surface 22 and a top surface 24. Board 20 may be of any conventional size thickness or edge contour and may be formed of such suitable materials as paper, cardboard, plastic, wood, metal or combinations thereof. The playing area of the upper surface 24 of the board 20 is divided into twelve radial sectors 26 (FIG. 9) representing the twelve celestial houses as follows: Aries, Taurus, Gemini, Cancer, Leo, Virgo, Libra, Scorpia, Sagittarius, Capricorn, Aquarius and Pisces.

As shown in FIG. 9, each radial sector 26 is provided with a numeral area 28 near the center hub area 30 to identify the celestial houses by the number 1 to 12 arranged in counter clockwise order about the center hub area 30. Each sector 26 is further provided with a zodiac house sign area 32 and a zodiac characteristic area 34. Each of the zodiac house sign areas (zodiac areas) 32 has imprinted or otherwise presented within the area thereof the sign or word identifying the particular house. For example, and as can best be seen by reference to FIGS. 1 and 9, the zodiac sign of the first house is shown by the sign 36 and the word "Aries" 38. Each of the zodiac characteristics areas 34 has imprinted or otherwise presented within the area thereof the characteristics of intelligence relating to the particular house associated with the sector. For example, referring again to FIGS. 1 and 9, the characteristics of intelligence 40 for the first house of Aries is as follows: Personal Self-Expression, Self Image, Personality, Self-Awareness, and How You Project Yourself.

As will be apparent as the description proceeds, the characteristics of each house or sign will cooperate with the intelligence suggested by their associated playing cards hereinafter discussed in interpreting the player's fortune.

Arranged in the hub area 30 of the game board 20 is a design 42 thereon and adding to the attractiveness of the game board.

The present invention also includes a plurality or deck of cards which are used in combination with the game board 20. The deck of cards is made up of a plurality of cards shown generally at 44 (FIG. 8) each of which has a bottom surface 46 and a top indicia bearing surface 48. The bottom surface may, for example, have decorative work (not shown) thereon. Generally, the indicia of the top indicia bearing surface is oriented in a generally common direction from one end of the card to the other end. As used herein, the term deck of cards shall have the same meaning as plurality of cards.

There are preferably fifty-four cards which are divided into two groups. The first group of cards are further divided into four subgroups of thirteen cards each. Each subgroup of cards has a first area thereon which has displayed therein indicia which may be words, numerals, symbols, or legendary matter relating to one of the standard card suits of hearts, clubs, spades and diamonds, and a second area having imprinted or otherwise presented therein indicia which comprises words, symbols or combinations thereof relating to various personal character traits, suggestions of actions to be taken, emotions, feelings, predictions of future events or happenings and the like which are generally referred to herein as characteristics and which are suggestive, through the intuitive and interpretive input of the reader or player, of at least a portion of the characteristics of a zodiac house to which the card is oriented.

The second group of cards comprises a pair of cards. One card is a "moon" card and is provided with a first indicia on the indicia bearing surface comprising words, symbols, or combinations thereof which relate to the moon and other indicia which are suggestive of mental feelings such as for example, emotions, moods, imagination, intuition, dreams, subconscious thoughts, response, and the like. The other card is a "sun" card and is provided with a first indicia, on the indicia bearing surface, comprising words, symbols, or combinations thereof which relate to the sun, and other indicia which are suggestive of mental attitudes such as, for example, achievement, life force spirit, self-awareness, self-expression, ego, positive mental attitude, material happiness, radiant energy, creativeness, and the like.

Figure 2:
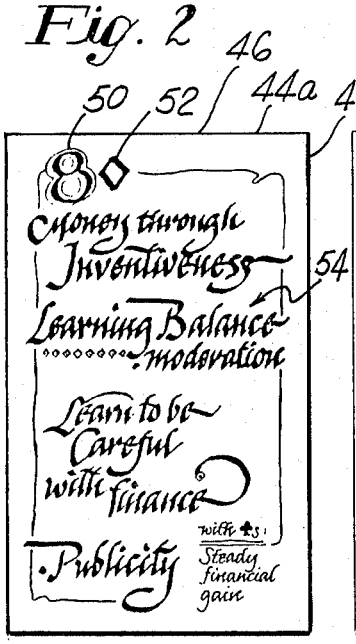
FIGS. 2 through 5 are detailed plan views of representative group suit cards of a typical card deck in accordance with the invention for playing the game.
Figure 3:
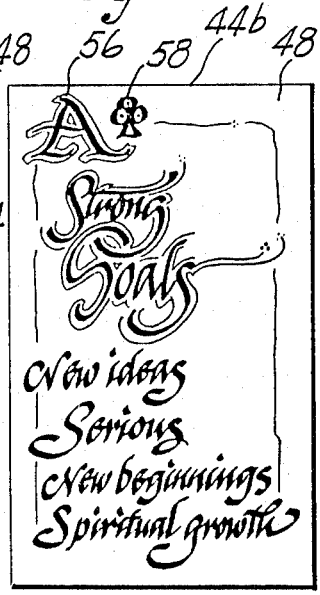
Figure 4:
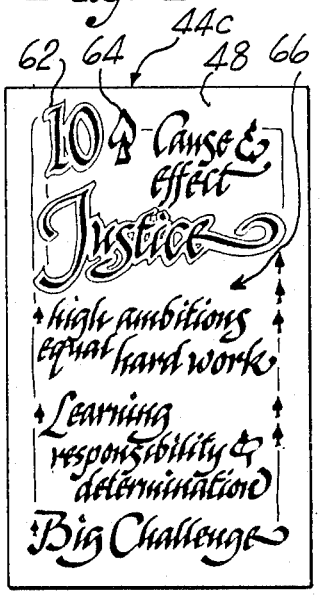
Figure 5:
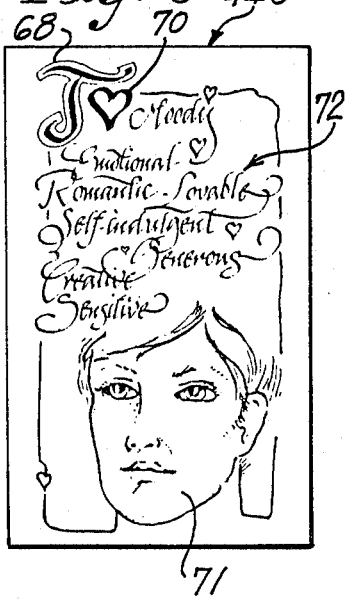

Referring now to FIGS. 2 through 5, there is illustrated one embodiment of a representative card from each of the four subgroups relating to diamond, clubs, spades and hearts. In FIG. 2, the card 44*a* is provided with first indicia comprising a numeral 50 and diamond symbol 52, identifying the card as belonging to the diamond suit subgroup, and a plurality of second indicia 54 setting forth the suggestive characteristics of the card. The card 44*b* of FIG. 3 is provided with a first indicia comprising a letter 56 and a club symbol 58 identifying the card as belonging to the club suit subgroup and a plurality of second indicia 60 setting forth the suggestive characteristics of the card. In FIG. 4, the card 44*c* is provided with first indicia comprising a numeral 62 and a spade symbol 64 identifying the card as belonging to the spade suit subgroup and a plurality of second indicia 66 setting forth the suggestive characteristics of the card. Similarly, card 44*d* of FIG. 5 is provided with a first indicia comprising a letter 68 and a heart symbol 70 identifying the card as belonging to the heart suit subgroup and a plurality of second indicia 72 setting forth the suggestive characteristics of the card. The cards may also include a representation of a countenance 71 as illustrated in FIG. 5.

Figure 6:
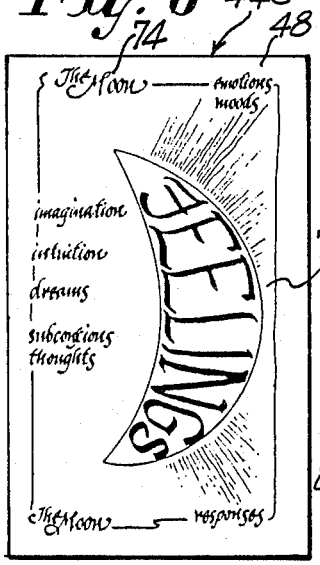
FIGS. 6 and 7 are detailed plan views of another group of non-suit cards of the invention for playing the game.
Figure 7:
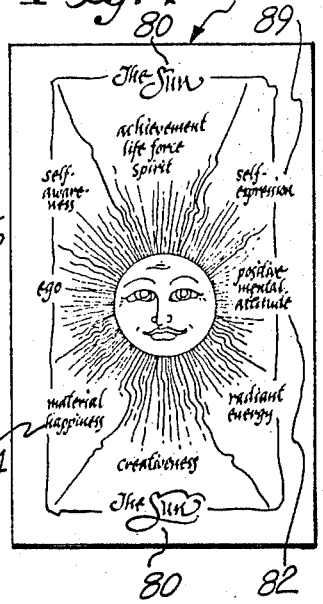

The second group of cards preferably comprises a pair of cards 44*e* and 44*f* as shown in FIGS. 6 and 7. One card 44*e* is a "moon" card and is provided with first indicia on the indicia bearing surface 48 comprising words "the moon" 74 and a symbol 76 which relates to the moon, and a plurality of second indicia 78, which are suggestive of mental feeling as follows; emotions, moods, imagination, intuition, dreams, subconscious thoughts and responses. The other card, 44*f*, is a "sun" card and is provided with a first indicia, on the indicia bearing surface, comprising the words "the sun" 80 and a symbol 82 which relates to the sun, and a plurality of second indicia 84 which are suggestive of mental attitudes as follows: achievement, life force, self-awareness, self-expression, ego, positive mental attitude, material happiness, radiant energy and creativity.

The following is a list of the first and second indicia making up the cards of four subgroups.

Ace of diamonds—A message, adventurous, surprise, new beginning, dynamic, energy, large gift.

King of diamonds—optimistic, enthusiastic, extravagant, independent, dynamic, aggressive, gregarious.

Queen of diamonds—intelligent, unpredictable, independent, aggressive, dynamic, extravagant, energetic, confident.

Jack of diamonds—temperamental, energetic, optimistic, resourceful, impatient, impulsive, restless, intelligent.

Ten of diamonds—big money, financial security, success, promotion.

Nine of diamonds—someone wishing for you, extra money, long journeys, education, seeking spiritual identity.

Eight of diamonds—money through inventiveness, learning balance, moderation, learn to be careful with finance, publicity.

Seven of diamonds—lucky, surprise money, fortunate changes around partnerships, need more freedom.

Six of diamonds—unsettled situation, change in work environment, nervous energy.

Five of diamonds—at your table talking, desire for freedom, in love or creativity, changes around children, investments.

Four of diamonds—something important, changes around the home, remodeling, moving.

Three of diamonds—small amount of money, part time job, communication, more effort needed for success.

Two of diamonds—something definite, financial, inventive, creative, synergism, gift.

Ace of clubs—strong goals, new ideas, serious new beginnings, spiritual growth.

King of clubs—practical, helpful, analytical, organized, discriminatory, artistic, affectionate, ambitious.

Queen of clubs—reliable, organized, fun-loving, gracious, sincere, logical, discriminating, ambitious.

Jack of clubs—stable, reliable, trustworthy, helpful, stubborn, sensible, enthusiastic, affectionate.

Ten of clubs—promotion, business opportunities, trip with other "tens" out of state.

Nine of clubs—protector card, journey, good luck, helpful friends, education, legal issues, with four of clubs, a message from a long distance.

Eight of clubs—work, other people's money, with five of hearts-a great opportunity, with ten of diamonds-more money or bonus.

Seven of clubs—coping with the opposition, working toward a balanced relationship, being busy.

Six of clubs—communication, advice, conversation skills, taking responsibility, opportunity for problem solving.

Five of clubs—good luck, things getting better, a friend helping you.

Four of clubs—a telephone call, message, letter, someone thinking of you.

Three of clubs—good luck, communication very soon, talent development, growth opportunity.

Two of clubs—a benefit, gift.

Ace of hearts—good, positive energy.

King of hearts—determined, dependable, romantic, kind, protective, emotional, creative, compassionate.

Queen of hearts—sensuous, emotional, sensitive, nurturing, creative, light-hearted, romantic, self-indulgent.

Jack of hearts—moody, emotional, romantic, lovable, self-indulgent, generous, creative, sensitive.

Ten of hearts—party, secure feeling, career advancement, public recognition.

Nine of hearts—the wish card, dreams come true, success, happiness, optimism, hope, luck.

Eight of hearts—sex, secret, love, great benefits, protection, healing.

Seven of hearts—wish of love, a surprise, with the four of hearts and with the seven of hearts, elopement soon.

Six of hearts—love or new friend in your life, comfortable, health improvement, natural growth.

Five of hearts—opportunity, success coming, an offer, creative talent.

Four of hearts—marriage, sharing, trust, stabilizing, happiness in home, emotional security.

Three of hearts—love affair, open mind, positive attitude, communication, developing situation.

Two of hearts—love of children, social enjoyment, gentle affection, harmony.

Ace of spades—A new beginning, major change, tremendous energy, challenge to overcome obstacles, decisions to be made, future growth.

King of spades—Powerful, demanding, cautious, responsible, charismatic, passionate, intense, sexy.

Queen of spades—sexy, secretive, confident, possessive, mysterious, magnetic, passionate.

Jack of spades—possessive, perceptive, sexy, compulsive, intense, charming, mysterious, dynamic.

Ten of spades—cause and effect, justice, high ambitions, equal, hard work, learning responsibility and determination, big challenge.

Nine of spades—become a truth seeker, learn to develop will power and determination, learn to overcome obstacles, education, travel, belief systems.

Eight of spades—time to think, plans for future, reassessment of goals and values, decision.

Seven of spades—frustration, a block in relationship, too much drinking or drugs, lack of compromise.

Six of spades—resolve problems, accept outcome and responsibility, transportation, moving on.

Five of spades—a test, coping with children, solving problems around your love life.

Four of spades—learning to cope with your emotions and solve the problem and not blame environment or situation.

Three of spades—a problem, resolve misunderstandings, communicate, something lost.

Two of spades—removal, change, watch finances.

NON-SUIT CARDS

The sun card—achievement, life force spirit, self-awareness, self-expression, ego, positive mental attitude, material happiness, radiant energy, creativeness.

The moon card—emotions, moods, imagination, intuition, dreams, subconscious thoughts, feelings, responses.

The fortune telling game of the present invention is played in the following manner. The player i.e. the person whose fortune is being read preferably first places a personal article, such as a ring 86 (FIG. 8), in the center 30 of the game board 20. The deck of 54 cards is then shuffled one or more times and preferably seven times with the indicia bearing surface facing downward and out of view of the player. Two cards, for example, 44*a* and 44*b* (FIGS. 2 and 3) are taken from the top of the deck and placed adjacent the number 1 house of Aries of the game board with the indicia bearing surfaces facing upward as best seen in FIGS. 8 and 9. The cards selected have several messages written on them. As used herein, the term card messages shall have the same meaning as second indicia suggestive characteristics. Not all card messages necessarily apply to the player. Normally, a reader—who may also be the player—interprets the messages on the cards in relation to the characteristics on the adjacent house suggested by the card messages. If two cards of the same suit are placed adjacent or "outside" the same house, they are considered to reinforce each other and may foretell a surprise for the player. In all plays the (player) reader relies upon his or her intuitive and interpretive input to select the combination of messages on the cards and characteristics of the adjacent house as suggested by the card messages to provide at least a portion of the player's fortune. The player then sequentially performs the same steps, in chronological order, for each of the zodiac houses.

Aries—The number one house, Aries, where the player begins, relates to self-image and appearance or in one word, you. The cards played in combination with this house relate and the messages contained may be interpreted as expressions of inner self and feelings. A face card of a suit in this house will reveal the player's personality traits.

Referring again to FIG. 9, there is illustrated one possible combination of two cards, 44*a* and 44*b*, played with the first house, Aries. A hypothetical (player) reader through intuitive and interpretive input might conclude that the message "Learn to be careful with finance" suggests the house characteristic, "how to protect yourself" and the message "moderation" suggests the characteristic "self image". Similarly, the messages "spiritual growth" and "strong goals" of card 44*b* might suggest the house characteristic "personal self-expression". In this manner, the (player) reader develops answers to questions of the player's love life, career, health, money, future events, etc.

Taurus—The player then selects the next two cards and places them adjacent the number two houses, Taurus. The characteristics of this house relate to material interest, finances or, in one word, money. The (player) reader then interprets the messages on the cards and the suggested relationships to the indicia of the house and combines one or more of the messages to foretell the player's current financial situation, money matters, or the player's own personal value system, which may be changing or developing.

Gemini—The next two cards are placed adjacent the number three house, Gemini, which relates to short trips and written or verbal communication. The messages contained on the cards are interpreted to suggest communication around the player.

Cancer—The next two cards are placed adjacent the number four house, Cancer. The characteristics of this house relate to real estate and domestic matters or, in one word, the home. The messages contained on the cards are interpreted to suggest material and emotional needs of one's self.

Leo—The next two cards are placed adjacent the number five house, leo, which relates to romantic situations, children, creative self-expression or, on one word, pleasures. The messages contained on the cards can be combined with the characteristics of the house to foretell social activities, entertainment and creative interest.

Virgo—The sixth house, Virgo, relates to state of health, vocation and service or, in one word, work. The two cards which are played in combination with this house can be interpreted to highlight and clarify the player's service or gift to humanity.

As can be appreciated, the first six houses, in general, refer to the player and the player's inner self.

The remaining six houses (7–12), in general, refer to player's situation in relation to the outer environment.

The player sequentially performs the same steps in chronological order for the remaining six houses which have the following characteristics.

Libra—Seventh House—relationships, partnerships, marriage.

Scorpio—Eighth House—other people's money, inheritance, psychic awareness, new beginnings, sex energy, power.

Sagittarius—Ninth House—philosophy, religion, long distance travel, higher education, pilgrimage, open-mindedness.

Capricorn—Tenth House—career, profession, public standing responsibilities, ambition, fame.

Aquarius—Eleventh House—goals, friends, groups, organizations.

Pisces—Twelfth House—secrets, mysterious things, private-self, unconscious thoughts, hidden weaknesses and strengths.

The fortune telling game of the present invention provides for further interpretive significance of the preponderance of a suit based on the cards which have been played. When a suit of played cards is in the majority, the reader (player) refers to a key word card that is applicable from the suit to reveal the characteristics of the suit for further interpretive input in the player's fortune telling objectives.

After placing two cards outside of each of the twelve houses, the reader has an additional optional play in which two cards are taken from the top of the deck and placed in the hub 30 of the game board face up. These cards will give the reader (player) an overall reading of the immediate future and general circumstances of the player. Additionally, the (player) reader can also look at combined messages from other houses on the game board for an in-depth understanding of the player's reading. For example, a message in the eleventh house relating to a goal a player wants to achieve may be better understood or clarified by looking at the twelfth house to observe any hidden weaknesses or strengths needed to be addressed to achieve the goal. Additionally, when a face card or cards appear within the first six houses in the play, the messages as described on the card or cards are interpreted to refer to the player. When face cards appear in the last six houses, the messages are interpreted to relate to either the player or to others in the player's life. That is, a person may be a mature king or queen as far as money matters, but less mature when dealing with relationships.

The key word or words and composite characteristics of each suit are as follows:

Diamonds—key—the mind. Diamonds relate to the season of spring as the first suit in the deck. A predominance of diamonds in the spread indicates a logical, practical thinker who possesses intelligence, psychic ability and good written and verbal communication skills. Players encountering a predominance of diamonds exhibit a light nature with an abundance of energy and enthusiasm. They usually attract positive vibrations which can lead them to desired goals. Such Players would do well to be aware of being too optimistic or overly enthusiastic. Since there is usually a history of good fortune surrounding most endeavors, there is a tendency to be impatient and jump into things too quickly. This can result in disappointments. An important principle to learn is to exercise caution and avoid opportunists.

Clubs—key—forming foundations. Clubs relate to the summer season as the second suit in the deck. A predominance of clubs indicates tremendous determination and hopefullness. This suit characterizes a success oriented, practical, persistent and responsible person who thinks logically and takes appropriate action. A predominance of clubs denote ability to lay the foundations for achieving financial independence. A player encountering a predominance of clubs takes nothing for granted, is highly discriminating and not easily taken advantage of.

Hearts—key—being in rhythm with the universal law. Hearts relate to the autumn season as the third suit in the deck. A predominance of hearts indicates a sensitive, emotional and usually spirited individual. A player encountering a predominance of hearts has a nature which is social, giving, charming, compassionate and fun-loving. Sensitivity to other's feelings and the ability to warmly communicate those feelings to others is a feature of such players. A predominance of hearts also symbolize happiness, relaxation, mediumistic and healing attributes. These players are the comforters of the universe and appreciate the golden rule. They represent inner feelings and are ruled by their hearts which can sometimes lead to trouble when too many self-sacrifices are exhibited. Trustworthiness and the ability to work well with others are additional attributes. Such players tends to be too easy-going and can be taken for granted if they do not learn to be discriminating.

Spades—key—growth and wisdom. Spades relate to the winter season as the last suit in the deck. A predominance of spades represent personal challenges in the life situation. Players encountering a predominance of spades possess the reserves of strength needed to cope along with the ability to solve problems and overcome obstacles. Such players have a need to draw upon the inner strength to remove the block around the individual's life force in order to maintain control of the situation. These players require development of a positive outlook with a focus on patience, persistence and perseverance. These players need to understand how to gain control of the situation so as not to be overpowered or swayed by their environment. There is a need to listen to the self's inner voice and learn to develop it, try to go slowly and not to be overwhelmed by the circumstances because a predominance of spades suggest a form of powerful energy if positively channeled. This energy can develop a creative and constructive force to deal with any problem and, remember, always turns to spring.

The following Table are lists of other key words which fall within each of the suits:

TABLE 1

| Diamonds | Hearts | Clubs | Spades |
|---|---|---|---|
| communication | compassion | ambition | challenges |
| energy | contentment | business | charisma |
| enthusiasm | emotions | friendship | decisions |
| impatience | love | goals | frustration |
| independence | relationships | logic | growth |
| intellect | sensitivity | luck | intensity |
| money | sensuality | organization | obstacles |
| optimism | sociability | stability | responsibilities |

It is to be understood that in one embodiment the invention contemplates that the foregoing tabular information be provided on a playing card (not shown) to form the key word playing card as discussed herein. As described herein, when a preponderance of a suit occurs based upon cards which have been played, the player consults the key word card which provides for further interpretive significance based upon the preponderant suit and the key words descriptive of that suit.

Without being limitative upon the claims, the following specific example of the playing of the game is offered:

SPECIFIC EXAMPLE

In playing the fortune telling card game of the present invention, one begins by shuffling the deck of fortune telling cards seven times. The fortune telling cards comprises a plurality of playing cards, each of which cards has a bottom and a top indicia bearing surface. The indicia of each top surface comprises characteristics suggestive of a relationship to at least a portion of the indicia giving the characteristics of a zodiac house depicted on a game board when oriented with the house. The plurality of cards comprises four groups of cards, each group of cards bearing additional indicia of one card suit: hearts, clubs, spades and diamonds.

The game board has top and bottom surfaces, the top surface being divided into a center hub section and twelve equal radial sectors extending from said hub section, each sector having an area embodying one of the twelve zodiac house signs, an area having displayed house identifying indicia. There is an information area having displayed therein with indicia giving the characteristics of the zodiac house identified with the related zodiac house area.

In playing, one begins by selecting a first and second card from the deck and placing the cards with the top indicia bearing surface facing upward adjacent to a first radial sector having displayed thereon indicia giving the characteristics of the zodiac house. The reader then determines which characteristics of the cards are suggestive of relationships to the characteristics of said zodiac house. The determined characteristics suggestive of relationships to the characteristics of the zodiac house are then set up to provide intuitive interpretations of the relationship to provide information pertinent to the player's personality, emotions, present or future romantic, health or financial status or similar pertinent information relating to the player or persons known to player. The steps above are then repeated with other cards from said deck for each of said zodiac houses.

It is apparent that modifications and changes may be made within the spirit and scope of the present invention, but it is my intention only to be limited by the appended claims.

As my invention, I claim:

1. A method of playing a fortune telling card game to provide information pertinent to the player whose fortune is being read comprising the steps wherein:

(a) The person shuffles a deck of fortune telling cards, said fortune telling cards comprising:

a plurality of playing cards, each of said cards having a bottom surface and a top indicia bearing surface, said indicia of each top surface comprising characteristics suggestive of a relationship to at least a portion of the indicia giving the characteristics of a zodiac house depicted on a game board when oriented with said house;

said plurality of cards comprising four groups of cards each group of cards bearing additional indicia of one card suit selected from the group consisting of hearts, clubs, spades and diamonds;

said game board having top and bottom surfaces;

said top surface being divided into a center hub section and twelve equal radial sectors extending from said hub section, each sector having an area embodying one of the twelve zodiac house signs, an area having displayed house identifying indicia, said identifying indicia being means, indicating the numerals 1 to 12, respectively, and an information area having displayed therein indicia giving the characteristics of the zodiac house identified with the related zodiac house area;

(b) The player selects a first and second card from said deck and placing said cards with the top indicia bearing surface facing upward adjacent to the radial sector having displayed thereon indicia giving the characteristics of the zodiac house which is associated with the identifying indicia indicating the numeral one;

(c) determining which characteristics of said cards are suggestive of relationships to the characteristics of said zodiac house to thereby interpret said relationships;

(d) intuitively interpreting the relationships of each of said cards to said house to thereby provide information pertinent to the player; and (e) repeating steps (a), (b), (c) and (d) with other cards from said deck for each of said zodiac houses in numerical succession.

2. The method of claim 1 wherein said deck of cards is shuffled seven times.

3. The method of claim 1 further comprising the player selecting from the top of the deck two additional cards as said cards reach the top of the deck;

placing said cards in the center of said hub section with the top indicia bearing surface facing upward; and interpreting the relationship of the indicia on said cards as they are suggestive of the overall fortune.

4. The method of claim 1 further including the initial step of placing a personal item of the game player upon the board.

5. The method of claim 1 further including the step of randomly selecting a non-suit card from the deck of cards and interpreting the significance of said non-suit card in relationship to the game board and the other cards on the game board.

6. A fortune telling game apparatus comprising:

a game board having top and bottom surfaces;

means for indicating a circular segment formed in the center portion of said top surface for receiving a playing piece, said playing piece comprising a personal article of the player;

a first means for defining a first set of twelve equal segmented sectors disposed radially outwardly about said circular segment;

means for indicating the numerals from 1 to 12 for each of the twelve zodiac houses;

one of said numeral means being disposed in each of said first segmented sectors in counter clockwise numerical order;

a second means for defining a second set of twelve equal segmented sectors, one such second segmented sectors extending radially outwardly from each of the first set of segmented sectors;

means for indicating one of the twelve zodiac house signs disposed in each of said second segmented sectors and corresponding to the numerical means of the adjacent first segmented sectors;

means for indicating a plurality of characteristics of the zodiac house of each of the second segmented sectors disposed adjacent the zodiac sign of each of said second segmented sectors;

a plurality of playing cards each having top and bottom surfaces, said plurality of cards comprising four groups of 13 cards; and means disposed upon said playing cards for indicating characteristics suggestive of a relationship to at least a portion of the zodiac house characteristics when oriented with a segmented sector containing a zodiac house sign;

means also disposed upon the top surface of each of said card groups for indicating the conventional symbols of a card suit selected from the group consisting of hearts, clubs, spades and diamonds.

7. The fortune telling game according to claim 6 further including a playing piece comprising a personal article of the player disposed on the means for indicating a circular segment.

8. A fortune telling game apparatus according to claim 6 further comprising:

a pair of playing cards each having top and bottom surfaces;

one card having means disposed on the top surface for indicating lunar symbols and characteristics of mental feelings; and one card having means disposed on the top surface for indicating solar symbols and characteristics of mental attitudes.

9. A fortune telling game apparatus according to claim 6 further comprising at least one card having disposed upon the top surface means for indicating the cards suits of hearts, clubs, spades and diamonds and means for indicating the key words descriptive of each of said suits.

10. A fortune telling game comprising:

a game board having top and bottom surfaces;

means forming a circular segment disposed in the center portion of said top surface for receiving a playing piece comprising a personal article of the player;

a first means for defining a first set of twelve equal segmented sectors disposed radially outwardly about said circular segment;

means for indicating the numerals from 1 to 12 for each of the twelve zodiac houses;

one of said numeral means being disposed in each of said first segmented sectors in counter clockwise numerical order;

a second means for defining a second set of twelve segmented sectors, one such second means extending radially outwardly from each of the first means;

means for indicating one of the twelve zodiac house signs disposed in each of said second segmented sectors and corresponding to the numerical means of the adjacent first segmented sectors;

means for indicating a plurality of characteristics of the zodiac house of each of the second segmented sectors disposed adjacent the zodiac sign of each of said second segmented sectors;

a plurality of playing cards each having top and bottom surfaces;

means for indicating characteristics suggestive of a relationship to at least a portion of the zodiac house characteristics when oriented with a segmented sector containing a zodiac house sign;

said plurality of cards comprising four groups of 13 cards;

means disposed upon the top surface of each of said card groups for indicating the conventional symbols of a card suit selected from the group consisting of hearts, clubs, spades and diamonds;

said plurality of playing cards further comprising one card having means disposed on the top surface for indicating lunar symbols and characteristics of mental feelings and a second card having means disposed on the top surface for indicating solar symbols and characteristics of mental attitudes.

11. The fortune telling game according to claim 10 further including a playing piece comprising a personal article of the player disposed on the means forming a circular segment.

* * * * *